United States Patent [19]

Young

[11] 4,185,221

[45] Jan. 22, 1980

[54] DOUBLE-ENDED FLUORESCENT LAMP HAVING A PARTITIONED ENVELOPE

[75] Inventor: Robert G. Young, Nutley, N.J.

[73] Assignee: Westinghouse Electric Corp., Pittsburgh, Pa.

[21] Appl. No.: 923,599

[22] Filed: Jul. 11, 1978

[51] Int. Cl.[2] ..... H01J 61/10; H01J 61/30; H01J 61/42

[52] U.S. Cl. ..... 313/485; 313/190; 313/204; 313/493

[58] Field of Search ..... 313/493, 204, 485, 190

[56] References Cited

U.S. PATENT DOCUMENTS

| | | | |
|---|---|---|---|
| Re. 22,896 | 7/1947 | Polevitzky . | |
| 2,030,715 | 2/1936 | Pirani et al. . | |
| 2,121,333 | 6/1938 | Barclay . | |
| 2,306,628 | 12/1942 | Lemmers | 313/204 |
| 2,451,043 | 10/1948 | Pennybacker | 313/204 X |
| 3,024,383 | 3/1962 | Doering | 313/204 |
| 3,084,271 | 4/1963 | Swanson . | |
| 3,194,997 | 7/1965 | Waly | 313/204 X |
| 3,508,103 | 4/1970 | Young . | |
| 3,903,447 | 9/1975 | Young et al. | 313/493 |

FOREIGN PATENT DOCUMENTS

| | | | |
|---|---|---|---|
| 481085 | 8/1975 | U.S.S.R. | 313/204 |

*Primary Examiner*—Palmer C. Demeo
*Attorney, Agent, or Firm*—D. S. Buleza

[57] ABSTRACT

The tubular envelope of a double-ended fluorescent lamp is provided with a partition assembly of sheet metal or other rigid material that is inserted into the envelope in the space between the electrodes and defines a single discharge channel which forces the arc to traverse the envelope an odd number of times in retroverted fashion, thus reducing the size of the lamp and providing a concentrated light source of high brightness. The partition assembly consists of a number of joined panels that radially extend from a common axis to the envelope walls and divide the interior of the envelope into an odd number of sectors that are interconnected and form a continuous discharge channel. Diaphragm components are fastened to each end of the partition assembly and laterally extend across the interior of the envelope to prevent the arc from bypassing the partition assembly or any of its planar segments.

10 Claims, 6 Drawing Figures

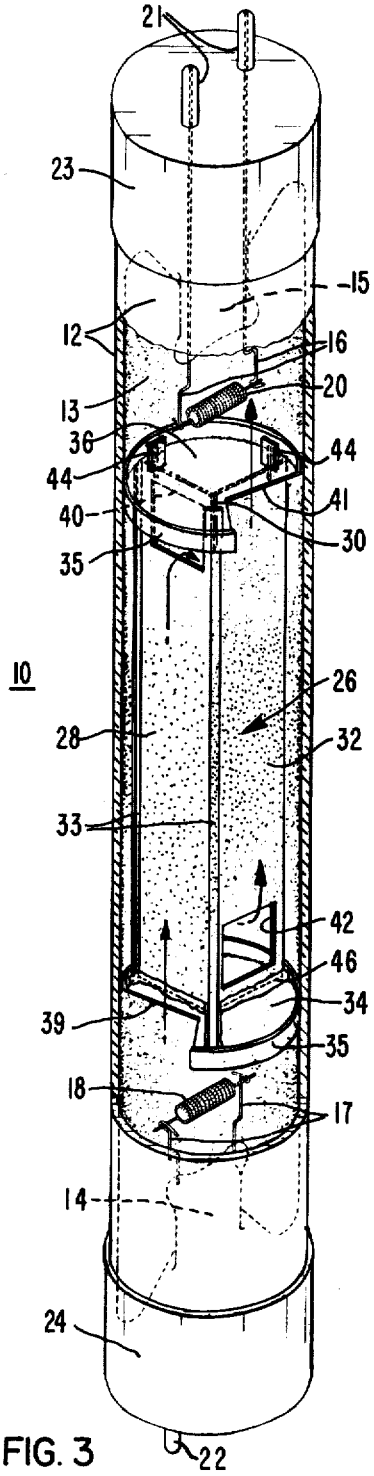
FIG. 3
FIG. 2
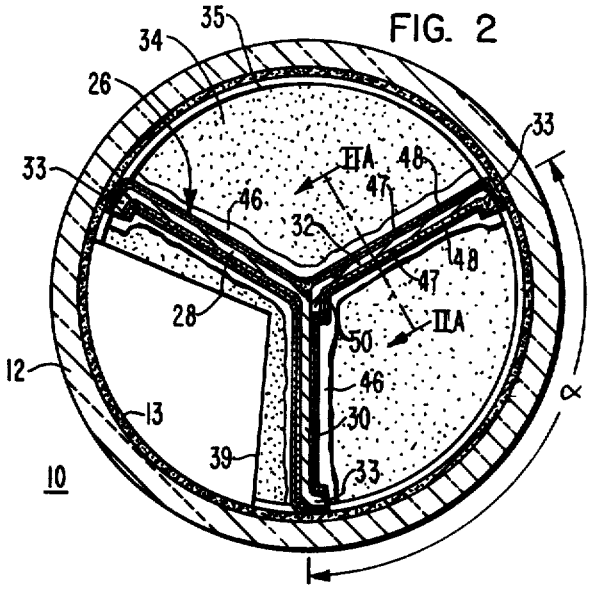
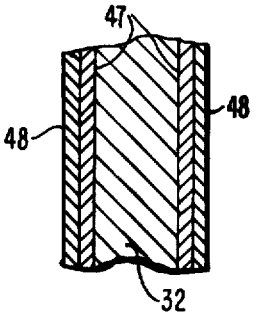
FIG. 2A
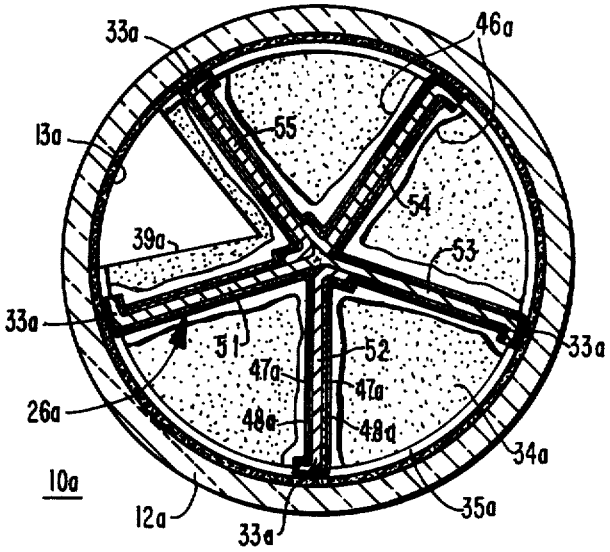
FIG. 5

DOUBLE-ENDED FLUORESCENT LAMP HAVING A PARTITIONED ENVELOPE

CROSS-REFERENCE TO RELATED APPLICATIONS

The subject matter of this application is related to that disclosed and claimed in concurrently-filed application Ser. No. 923,526 of R. G. Young, the author of the present invention, which application is assigned to the same assignee as the present application.

BACKGROUND OF THE INVENTION

1. Field of the Invention

This invention relates to electric discharge lamps and has particular reference to an improved fluorescent lamp of double-ended construction that is of compact size and constitutes a concentrated light source of high brightness when energized.

2. Description of the Prior Art

Electric discharge lamps having envelopes which are internally partitioned to provide one or more elongated discharge paths are generally well known in the art. U.S. Pat. No. 2,121,333 issued June 21, 1938 to Barclay discloses a single-ended discharge lamp having glass panels which are joined to the glass envelope and serve as the partition means. A single-ended fluorescent lamp having a tubular envelope that contains a partition comprising a glass or ceramic panel, or one which is fashioned from a stiffened sheet of fiberglass or the like, is disclosed in U.S. Pat. No. 3,024,383 issued Mar. 6, 1962 to Doering. The partition component is supported by a disc-like base member that is seated on top of the stem and extends to the envelope wall.

Flat or panel-like fluorescent lamps having partitions that are fabricated from sheet metal which is coated with a phosphor are also known in the art and are disclosed in U.S. Pat. No. Re. 22,896 issued July 8, 1947 to Polevitzky and U.S. Pat. No. 3,508,103 issued Apr. 21, 1970 to Young, the author of the present invention. An electric discharge lamp of single-ended construction having an envelope that contains an arc-enclosure consisting of metal baffles and light-transmitting side panels that are secured to a stem and define a tortuous path for the arc is disclosed in U.S. Pat. No. 2,030,715 issued Feb. 11, 1936 to Pirani et al.

Fluorescent lamps of double-ended construction having a plurality of electrodes at each end and a partition structure that divides the envelope interior into several independent arc channels which extend directly between opposed pairs of electrodes are disclosed in U.S. Pat. Nos. 3,084,271 issued Apr. 2, 1963 to Swanson and 3,194,997 issued July 13, 1965 to Waly.

SUMMARY OF THE INVENTION

While the prior art partition-discharge lamps were satisfactory from a functional standpoint in that they reduced the physical size of the lamp and thus provided a more concentrated light source, they are difficult and expensive to manufacture on a mass-production basis and have certain structural features which present serious quality control problems. The use of rigid partition panels that are sealed to the walls of the glass envelope, for example, frequently introduces strains in the glass which could cause the envelope to crack under certain conditions. In the case of double-ended fluorescent lamps, the prior art use of multiple electrodes at each end of the envelope required specially constructed multi-lead mounts and sealing techniques for the lead wires, etc.

In accordance with the present invention, a fluorescent lamp of double-ended construction is provided which contains a partition assembly of such design that it permits the lamp to be manufactured in the usual fashion with stem and electrode components of the type used for conventional fluorescent lamps. These advantages are achieved by employing a standard two-lead glass stem and a coiled electrode at each end of the envelope, and by inserting a preformed partition assembly in the space between the electrodes that divides the envelope interior into a single continuous discharge channel which forces the arc to longitudinally traverse the envelope an odd number of times in retroverted fashion. The partition assembly is preferably constructed by joining a number of sheet metal panels together along a common axis so that they provide radially-extending planar segments or vanes which divide the envelope into a series of interconnected chambers or sectors. The ends of the partition assembly are closed by diaphragm components that prevent the arc from bypassing the partition, or any of its planar segments, but permit the arc to pass through the terminal portions of the arc channel to the associated electrodes at each end of the lamp.

BRIEF DESCRIPTION OF THE DRAWINGS

A better understanding of the invention will be obtained from the exemplary embodiments shown in the accompanying drawings, wherein:

FIG. 2 is an enlarged cross-sectional view through a partitioned portion of the lamp shown in FIG. 1;

FIG. 2A is an enlarged cross-sectional view through one of the phosphor-coated partition panels;

FIG. 3 is a perspective view of the fluorescent lamp shown in FIGS. 1 and 2 but with the partition assembly intact to show the retroverted manner in which the arc traverses the envelope;

FIG. 5 is an enlarged cross-sectional view through an alternative fluorescent lamp embodiment having a partition assembly that divides the interior of the envelope into five interconnected sectors and thus forces the arc to pass through the envelope a corresponding number of times.

DESCRIPTION OF THE PREFERRED EMBODIMENTS

Figure 1:
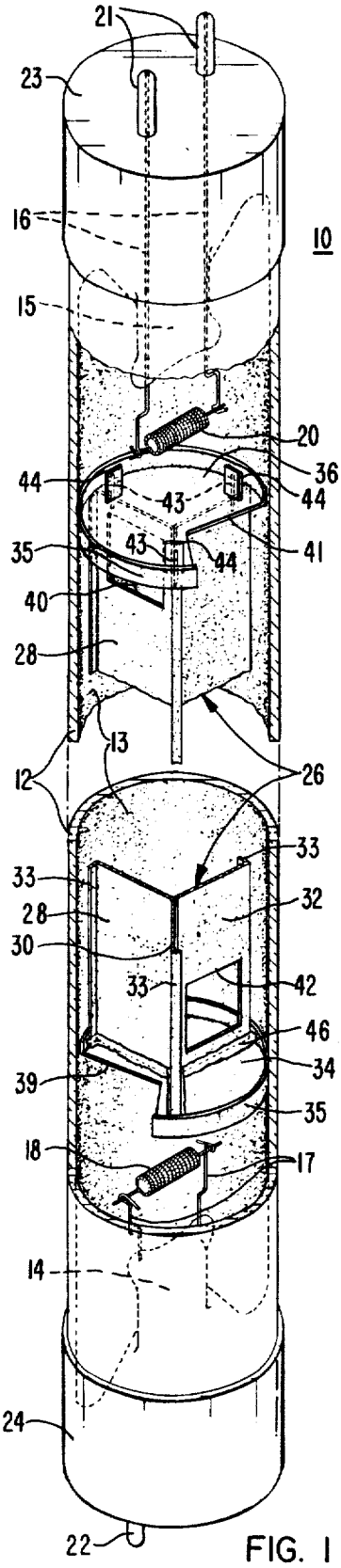
FIG. 1 is a perspective view of a double-ended fluorescent lamp that embodies the invention, portions of the envelope and partition assembly being removed for illustrative purposes.

As shown in FIG. 1, the improved fluorescent lamp 10 of the present invention employs a standard tubular glass envelope 12 of circular cross-section that has an inner coating 13 of suitable ultraviolet-responsive phosphor and is terminated at each end by conventional two-lead type glass stem assemblies 14 and 15. The paired lead-in wires 16 and 17 are hermetically embedded in the press seals of the respective stems and support suitable thermionic electrodes 18 and 20 that are located at opposite ends of the envelope 12. The electrodes 18 and 20 are of the type customarily employed in fluorescent lamps and thus consist of tungsten wire coils that are coated with a suitable electron-emission material. The outer ends of the lead-in wires 16 and 17 are connected to suitable terminals such as metal pins 21 and 22 that are anchored in base members 23 and 24 attached to the sealed ends of the envelope 12. In accordance with standard lamp-making practice, the envelope 12 is evacuated through a glass tubulation (not shown) on one of the stem assemblies, and then charged with a suitable fill gas (such as argon at several torrs) and dosed with a predetermined amount of mercury via such tubulation before it is hermetically sealed.

The interior of the envelope 12 is divided into a plurality of interconnected chambers or sectors by a partition assembly 26 that is inserted into the envelope before the latter is sealed to the stem assemblies 14 and 15. Partition assembly 26 is of such dimensions that it makes a snug fit with the walls of the cylindrical envelope 12 and is frictionally locked in place between the electrodes 18 and 20 with the ends of the partition spaced and isolated from the electrodes, as shown in FIG. 1. While the partition assembly 26 can be fabricated from any suitable sheet material such as mica, fiberglass and similar inert materials, it is preferably made from sheet metal. Stainless steel, nickel-iron alloy, or nickel sheet having a thickness of about 0.13 millimeter is a satisfactory material.

The partition assembly 26 in the particular embodiment illustrated in FIGS. 1–4 consists of three planar segments such as panels 28, 30 and 32 that are joined together along a common axis and extend both longitudinally within the envelope 12 and radially outward from the common axis to the envelope wall. The partition panels are so arranged that the interior of the envelope 12 is divided into three interconnected sectors of the same shape and size (each having an angular span $\alpha$ of about 120°), as shown more particularly in FIG. 2. The ends of the partition assembly 26 are closed by suitable members such as transversely extending diaphragm components 34 and 36 of disc-like configuration that are seated against the ends of the partition panels 28, 30 and 32 and thus constitute barriers to the electric discharge which prevent the arc from bypassing the partition assembly 26, or any of its planar segments, and jumping directly between the electrodes 18 and 20.

As will be noted in FIG. 1, diaphragm 34 has an angular sector removed to provide an opening 39 that provides a connecting passageway from electrode 18 into the envelope sector defined by partition panels 28 and 30 so that the arc has access to another opening 40 in panel 28 at the opposite end of the lamp 10. Diaphragm 36 also has an angular portion removed to provide a second opening 41 that provides a passageway from electrode 20 to the envelope sector defined by partition panels 30 and 32, thus permitting the arc to reach a second aperture 42 in panel 32 at the other end of the lamp 10. The diaphragm openings 39, 41 thus provide passageways from the respective electrodes to the envelope sectors that constitute the terminal portions of the continuous discharge channel.

The diaphragm components 34, 36 are locked in tight abutting relationship with the ends of the partition panels 28, 30 and 32 by coupling means consisting of pin-like elements 43 that are fastened to the respective partition panels, extend through apertures in the diaphragms and have tab-like anchoring members 44 attached to their protruding ends, which members are firmly seated against the outer faces of the respective diaphragms. Potential arc-leakage paths through small gaps or fissures along the abutted end edges of the partition panels 28, 30, 32 and the diaphragms 34, 36 are eliminated by interposing sealing means such as generally Y-shaped strips 46 (only one of which is shown in FIG. 1) of an inert compliant material between these components and pressing the end edges of the partition segments into nested relationship with the strips. While any suitable inert material (such as glass wood or quartz wool) which will not contaminate the lamp can be used as the sealing strips 46, good results have been obtained by making them from a felt-like material composed of interlocked silica and alumina fibers that is marketed under the trade name "Fiberfrax" ceramic fiber by the Carborundum Company, Niagara Falls, New York.

When the partition panels 28, 30, 32 and the diaphragm components 34, 36 are fabricated from a suitable sheet metal, then the pin-like members 43 and tab-like anchoring elements 44 can comprise metal studs and metal tabs, respectively, that are welded to one another and to the associated sheet metal panels (as shown in FIGS. 1 and 3).

In accordance with the teachings of the aforementioned concurrently-filed application Ser. No. 923,526, the longitudinal peripheral edges of the partition panels 28, 30 and 32 are preferably provided with short laterally-extending flanges 33 which overlie and effect a snug fit with the inner walls of the tubular envelope 10 and thus prevent the arc from penetrating small cracks or gaps along the envelope-partition interface. Each of the diaphragm components 34 and 36 are also provided with peripheral flanges 35 for the same purpose.

As shown more particularly in FIG. 2, the partition panels 28, 30 and 32 are each coated with a suitable ultraviolet-responsive phosphor 48. When the partition assembly 26 is made from sheet metal (as in the illustrated embodiment), the light output of the lamp 10 will be enhanced if the sheet metal is first coated with a light-reflecting layer 47 of a suitable inert material such as titania that can be formed by suspending powdered $TiO_2$ in a suitable vehicle (ethyl cellulose lacquer, for example) to provide a "paint" that is applied to the sheet metal. In addition to $TiO_2$, materials such as MgO, $BsSO_4$, $Al_2O_3$, ZnO and mixtures thereof can also be used as the light-reflecting coating. As illustrated in FIGS. 2 and 2A, the light-reflecting coating 47 is located between the sheet metal and the phosphor coating 48.

As will also be noted in FIG. 2, fabricating the partition assembly 26 from sheet metal facilitates the manufacture of this component since it permits the partition to be fashioned from only two pieces of metal, one of which is twice the width of the other and is bent at its midpoint and then welded along the bend to a lip or flange 50 provided on the other piece. The partition panels thus intersect at a common axis that is coincident with the envelope axis and they are so spaced from each other that the interior of the envelope 12 is divided into three sectors or channels of about the same shape and size.

As shown in FIG. 3, the openings 39 and 41 in the respective diaphragm components 34 and 36 are angularly offset from one another and so arranged relative to the apertures 40 and 42 in the panels 28 and 32 that the partition assembly 26 defines a single continuous discharge channel. The channel, as indicated by the arrows in FIG. 3, extends from electrode 18 through the opening 39 in diaphragm 34, along partition panels 28 and 30 to diaphragm 36 and through aperture 40 in panel 28 at the opposite end of the lamp 10, back along partition panels 28 and 32 toward the other diaphragm component 34, through aperture 42 in panel 32, and finally along partition panels 30 and 32 and through diaphragm opening 41 to electrode 20 at the other end of the fluorescent lamp 10. The lamp is accordingly a "three-pass" type lamp since the arc traverses the envelope 12 three times as it passes from one electrode to the other.

In order to obtain maximum light output and efficacy, all of the surfaces of the envelope 12, the partition assembly 26 and the diaphragm components 34 and 36 that are exposed to the electric discharge and the ultraviolet radiations are coated with a suitable phosphor.

Figure 4:
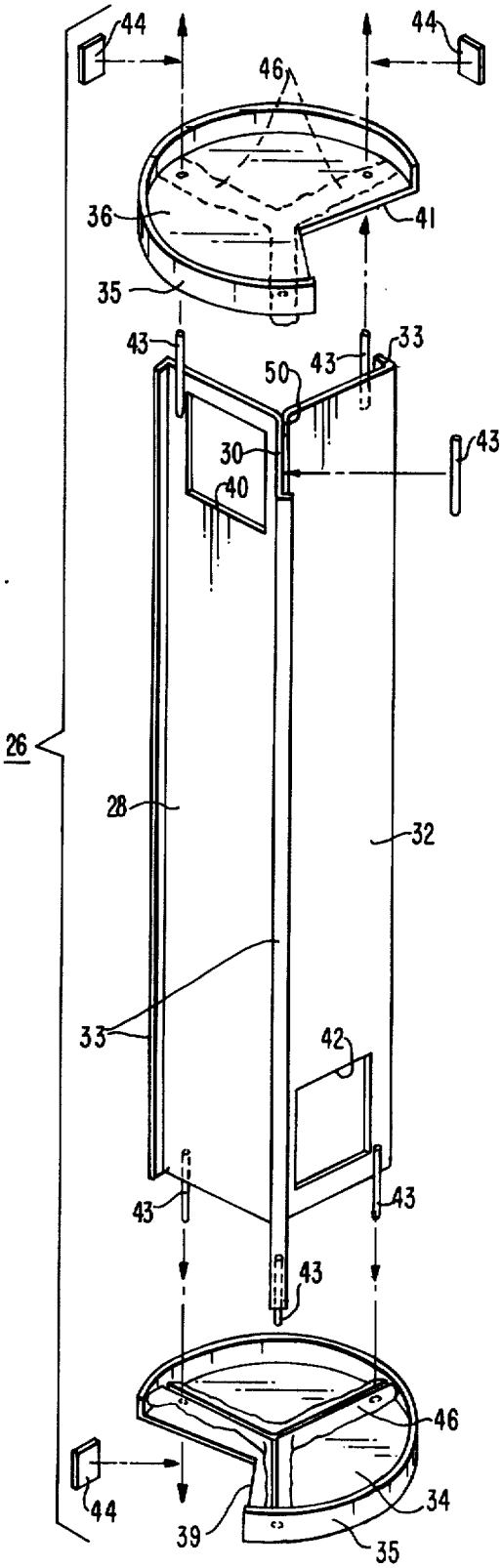
FIG. 4 is an exploded perspective view of the partition assembly employed in the lamp shown in FIGS. 1–3.

The manner in which the partition assembly 26 can be readily fabricated from metal parts that are interfitted and welded to one another is illustrated in FIG. 4. As shown, a single piece of sheet metal is longitudinally bent along its midpoint to form partition panels 28 and 30 and the flanged end 50 of another piece of sheet metal is welded to the bend to form the third partition panel 32. The metal studs or pins 43 are then spot welded to the ends of the respective panels and the protruding ends of the pins are inserted through holes in the sheet metal diaphragm members 34 and 36 so that the end edges of the panels are nestingly seated against Y-shaped sealing strips 46 of compliant material previously placed within each of the diaphragm members. With the diaphragm members firmly pressed against the ends of the joined partition panels, metal tabs 44 are seated against the outer faces of the diaphragm members and then spot welded to the protruding ends of the pins 43, thus locking the components in such pressured relationship and completing the partition assembly 26. The resulting structure is then coated with a thin layer of suitable light-reflecting material ($TiO_2$ for example) and a covering layer of a suitable phosphor and, after the coatings have dried and been baked to "burn out" the binders etc., the assembly 26 is forcibly inserted into the phosphor-coated envelope 12.

ALTERNATIVE "FIVE-PASS" LAMP (FIG. 5)

The invention is not limited to "three-pass" type fluorescent lamps of doubled-ended construction but can also be employed in discharge lamps having partition assemblies that force the arc to traverse the envelope any desired odd number of times.

An alternative "five-pass" type fluorescent lamp embodiment **10*a* that contains a partition assembly 26*a* which has five radially-extending vanes or panels 51, 52, 53, 54 and 55 that have flanged edges 33*a* and divide the envelope interior into five interconnected sectors of substantially the same shape and size is shown in FIG. 5. As will be noted, the partition assembly 26*a* is desirably constructed from only four pieces of sheet metal that are bent and welded together along a common axis that is coincident with the axis of the tubular envelope 12*a*. The panels are coupled to flanged diaphragm components having angularly offset openings that cooperate with suitable apertures in selected panels of the partition assembly 26*a* to form a single continuous discharge channel (as in the previous embodiment) which traverses the envelope five times in retroverted fashion. Only one diaphragm component 34*a* and its flange 35*a* and opening 39*a*** are shown.

As in the FIGS. 1–4 embodiment, the diaphragm components and partition assembly **26*a* are coated with a suitable phosphor 48*a* and, in the case of a sheet metal partition assembly of the type illustrated, the partition is also provided with a layer 47*a* of suitable light-reflecting material that is located between the metal surfaces and the phosphor coating 48*a*. The flanged peripheral edges of the diaphragm and partition panel components, together with properly shaped sealing strips 46*a*** of compliant material, force the arc to follow the tortuous but continuous channel, as described in the previous embodiment.

While the envelope, diaphragm and partition components can be coated with various types of ultraviolet-responsive phosphor, when the lamp is intended for use in lighting applications that require optimum visual clarity and color rendering of the illuminated objects or scene, a phosphor coating which contains a blend of three phosphors that emit visible radiations in three different selected portions of the spectrum is desirably employed to provide a so-called "prime color" fluorescent lamp, pursuant to the teachings of W. A. Thornton in the article entitled "Luminosity And Color-Rendering Capability of White Light", Journal of the Optical Society of America, Volume 61, No. 9, September 1971, p. 1155. As a specific example, a suitable phosphor blend for a fluorescent lamp of this type contains manganese-activated zinc silicate, europium-activated strontium chloroapatite and europium-activated yttrium oxide phosphors.

I claim as my invention:

1. An electric discharge lamp of the double-ended type comprising;

an elongated vitreous envelope that contains an ionizable medium and is sealed at each end, lead-in conductor means extending through each of the sealed ends of said envelope, a single electrode located at each end of said envelope and connected to the associated lead-in conductor means, and a partition assembly disposed in the space between said electrodes and including a plurality of longitudinally-extending planar segments and a pair of transversely-extending members that are disposed at the respective ends of the planar segments and together with said planar segments define a single continuous discharge channel which extends from one of said electrodes to the other of said electrodes and thus forces the arc to traverse the envelope an odd number of times longitudinally and in a retroverted manner between said electrodes, the planar segments of said partition assembly laterally extending in radial fashion from a substantially common axis to the walls of the envelope and having their longitudinal edges in snug-fitting relationship with said envelope walls so that the interior of the envelope is divided into an odd number of interconnected sectors which comprise the continuous retroverted discharge channel.

2. The double-ended discharge lamp of claim 1 wherein;

each of said transversely-extending end members comprises a diaphragm component that extends across the interior of the envelope and constitutes a barrier to the electric discharge so that the arc does not bypass any of the planar segments of the partition assembly, and each of said diaphragm components has an opening therein which defines a passageway from the associated electrode to the respective envelope sectors that constitute the terminal portions of the continuous discharge channel.

3. The double-ended discharge lamp of claim 1 wherein the inner surface of said envelope is coated with phosphor and said lamp thus comprises a fluorescent lamp.

4. The double-ended fluorescent lamp of claim 3 wherein;

said partition assembly is composed of sheet metal and is also coated with phosphor, and a layer of light-reflective material is disposed between the phosphor coating on the partition assembly and the underlying surfaces of said assembly.

5. The double-ended fluorescent lamp of claim 4 wherein said light-reflective layer is a material of the group consisting of $TiO_2$, MgO, $BaSO_4$, $Al_2O_3$, ZnO and mixtures thereof.

6. The double-ended fluorescent lamp of claim 3 wherein;

said envelope is of tubular configuration, and said ionizable medium comprises a fill gas and a predetermined quantity of mercury.

7. The double-ended fluorescent lamp of claim 6 wherein;

the planar partition segments are fabricated from sheet metal panels that are joined together in the region of said common axis, said diaphragm components are also fabricated from sheet metal, and each diaphragm component is held in tight abutting engagement with the associated ends of the planar partition segments by coupling means.

8. The double-ended fluorescent lamp of claim 6 wherein the surfaces of the partition assembly and diaphragm components that are exposed to the electric discharge are also coated with phosphor.

9. The double-ended fluorescent lamp of claim 7 wherein said coupling means comprises (a) metal pin-like elements that protrude from the respective partition panels and extend through apertures in the associated diaphragm components, and (b) laterally-extending anchoring members that are integral with the protruding ends of the respective pin-like elements and are seated against the outer face of the associated diaphragm component.

10. The double-ended fluorescent lamp of claim 6 wherein;

said tubular envelope is of substantially circular cross-section, said diaphragm components each comprise a disc-like member that extends across the interior of said envelope, the substantially common axis of the radially-extending planar segments of the partition assembly is substantially coincident with the longitudinal axis of the tubular envelope, and each of said disc-like diaphragm members have an opening therein that defines a passageway from the associated electrode to the respective envelope sectors that constitute the terminal portions of the continuous discharge channel.

* * * * *